US009314093B2

(12) United States Patent
Heien et al.

(10) Patent No.: US 9,314,093 B2
(45) **Date of Patent: *Apr. 19, 2016**

(54) DEVICE HOLDER

(71) Applicants: Troy A. Heien, Laramie, WY (US); Robert Skophammer, Cheyenne, WY (US)

(72) Inventors: Troy A. Heien, Laramie, WY (US); Robert Skophammer, Cheyenne, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/557,417

(22) Filed: Dec. 1, 2014

(65) Prior Publication Data

US 2015/0201744 A1 Jul. 23, 2015

Related U.S. Application Data

(63) Continuation of application No. 13/066,794, filed on Apr. 25, 2011, now Pat. No. 8,899,458.

(60) Provisional application No. 61/456,656, filed on Nov. 10, 2010.

(51) Int. Cl.

| | |
|---|---|
| ***A45F 5/00*** | (2006.01) |
| ***A45C 1/04*** | (2006.01) |
| ***F41C 33/02*** | (2006.01) |
| ***F42B 39/02*** | (2006.01) |
| ***A45F 5/02*** | (2006.01) |

(52) U.S. Cl.

CPC ..... *A45F 5/021* (2013.01); *A45F 2200/0516* (2013.01); *Y10T 24/3991* (2015.01)

(58) Field of Classification Search

CPC ..... A45F 5/02; A45F 5/021
USPC ..... 224/249, 671, 673, 677, 672, 660, 663, 224/665, 676, 236–240, 675; 24/115 K
See application file for complete search history.

(56) References Cited

U.S. PATENT DOCUMENTS

| | | | | | |
|---|---|---|---|---|---|
| 1,281,299 | A | | 10/1918 | Crosson | |
| 2,983,412 | A | | 5/1961 | Ferguson | |
| 3,032,244 | A | * | 5/1962 | Zeabari | 224/242 |
| 3,122,854 | A | | 3/1964 | Boertlein, Sr. et al. | |
| 3,497,676 | A | * | 2/1970 | Gravatt | 219/521 |
| 4,174,793 | A | * | 11/1979 | Wisowaty | 224/240 |
| 4,303,187 | A | | 12/1981 | Berman et al. | |
| 4,356,943 | A | | 11/1982 | Berman et al. | |
| 4,389,806 | A | | 6/1983 | Herring | |
| 4,917,281 | A | | 4/1990 | Ostermiller | |
| 5,174,483 | A | | 12/1992 | Moore, IV et al. | |
| 5,233,942 | A | | 8/1993 | Cooper et al. | |
| D367,356 | S | * | 2/1996 | Brown, Jr. | D3/226 |

(Continued)

*Primary Examiner* — Brian D Nash
*Assistant Examiner* — Derek Battisti
(74) *Attorney, Agent, or Firm* — Dinsmore & Shohl LLP

(57) ABSTRACT

A holder for carrying cell phones and other small items is arranged to attach to a belt or other strap, or to a belt loop. The holder is of simple construction, including an elongated backing member and a cover that is attached to the bottom region of the backing member to form a pocket or holster that is open at the top. The backing member is divided near its upper end by a fold to form a first flap and a generally rectangular opening through the backing member, sized and shaped to accommodate a belt loop, is placed adjacent to and below the fold. A second flap is attached to the backing member at a location adjacent to and below the opening and is arranged to fold upwardly to cover the opening and to form a channel for a belt or other strap. The second flap is secured in that position by folding down the first flap and securing it to the second flap.

10 Claims, 5 Drawing Sheets

(56) References Cited

U.S. PATENT DOCUMENTS

| | | | | |
|---|---|---|---|---|
| 5,511,704 | A | 4/1996 | Linderer | |
| 6,412,674 | B1 | 7/2002 | Lipke | |
| 6,473,941 | B2 | 11/2002 | Mei et al. | |
| 6,651,854 | B1 | 11/2003 | LaCoste | |
| 6,859,945 | B1 | 3/2005 | Crawford | |
| D588,801 | S | 3/2009 | Cicione | |
| 7,770,770 | B2 | 8/2010 | Murdoch et al. | |
| 8,453,898 | B2 | 6/2013 | Ewins | |
| 8,899,458 | B1 * | 12/2014 | Heien et al. | 224/675 |
| 2003/0066855 | A1 | 4/2003 | Stone | |
| 2005/0284904 | A1 | 12/2005 | Knapp et al. | |
| 2006/0091174 | A1 | 5/2006 | Mooney | |
| 2006/0219747 | A1 | 10/2006 | Gallucci | |
| 2007/0205244 | A1 | 9/2007 | Hewes | |

* cited by examiner

DEVICE HOLDER

REFERENCE TO RELATED APPLICATIONS

This application claims the benefit of U.S. Provisional Patent Application No. 61/456,656 which was filed on Nov. 10, 2010. This application is also a Continuation of U.S. Ser. No. 13/066,794 filed Apr. 25, 2011 which is incorporated by reference.

BACKGROUND OF THE INVENTION

1. Technical Field

This invention relates generally to a holder for items, such as electronic devices, that attach to a belt or to a belt loop.

More specifically, this invention relates to a holster-like carrier for small items, particularly cell phones, that securely attach to either a belt or to a belt loop.

2. Description of Related Art

There are many examples in the prior art of holders which attach to a belt for carrying small items such as tools and electronic devices. Most are arranged to attach to a belt by means of a hook or spring clip or to pivot on a swivel that is attached to a belt or other article of clothing. One such device is described in a published United States patent application No. US 2003/0066855. That application describes a holder for small articles which attaches both to a belt and a belt loop so that the holder is prevented from sliding along the belt. The holder includes a plate having two apertures; one for receiving the belt and the other for receiving the belt loop. Articles to be carried are attached to the plate.

A patent to Mei et al, U.S. Pat. No. 6,473,941 discloses a fastening assembly that utilizes a snap arrangement for attaching an electronic device onto a belt loop of an article of clothing such as a pair of pants. A bag or carrying case for an electronic device such as a cell phone is then attached to the fastening assembly by means of another snap part.

Yet another holster for a cell phone or similar electronic device is described in a published United States patent application No. US 2007/0205244. The holster is made of a single piece of leather and preferably attaches to an article of clothing through two belt loops.

The holder of this invention provides a secure, attractive, and comfortable carrying means for electronic devices, small tools, and like items. It is easily attached and detached from an article of clothing, provides convenient access to the item carried, is inexpensive to manufacture, and can readily be imprinted with advertising matter to serve as a promotional, as well as functional, article.

SUMMARY OF THE INVENTION

This invention provides a holder for a cell phone or other small item and fastens onto a belt or belt loop of a user, or to a strap attached to another item carried by the user. In one embodiment, the holder includes an elongated backing member to which a cover is attached so as to form an open-topped pocket that is sized and shaped to accommodate the item. The holder is attached to a belt by inserting the backing member upwardly behind the belt, then over the belt and away from the user's body, and then downwardly to form a channel for the belt, and secured. An opening through the backing member for a belt loop is located above the cover top and, when attaching the holder, the loop is inserted through the opening and is secured to the holder by means of a belt loop capture strap. The outer surface of the cover may also serve as a platform for advertising matter such as a company logo or trademark

BRIEF DESCRIPTION OF THE DRAWING

The accompanying drawings illustrate specific embodiments of the invention in which.

DESCRIPTION OF PREFERRED EMBODIMENTS OF THE INVENTION

Figure 1:
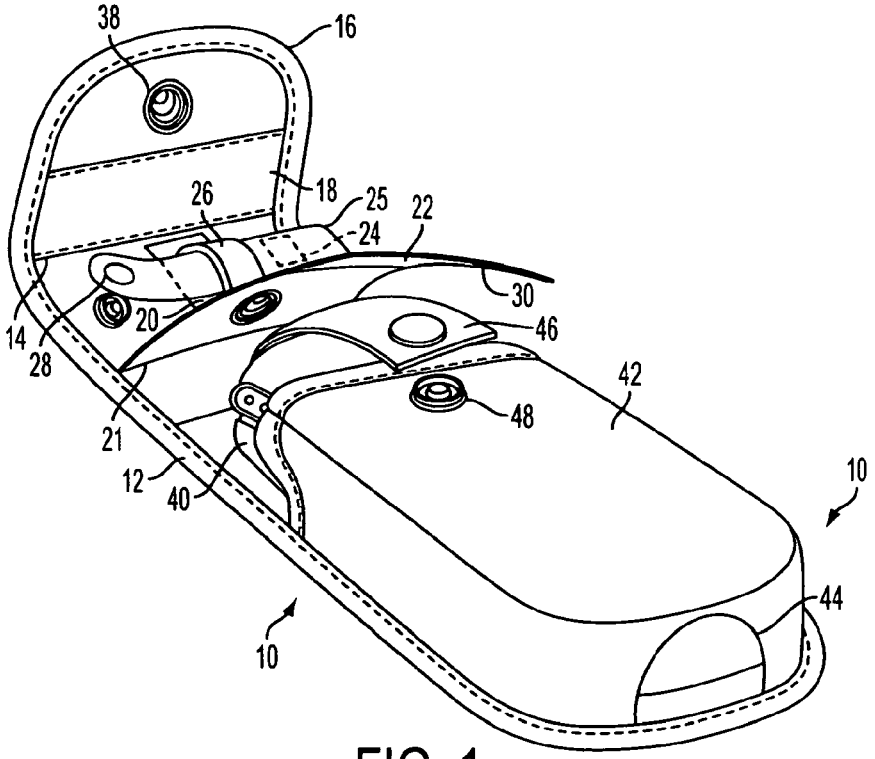
FIG. 1 is an oblique plan view of the device holder of this invention showing its attachment to an article of clothing through a belt loop.
Figure 2:
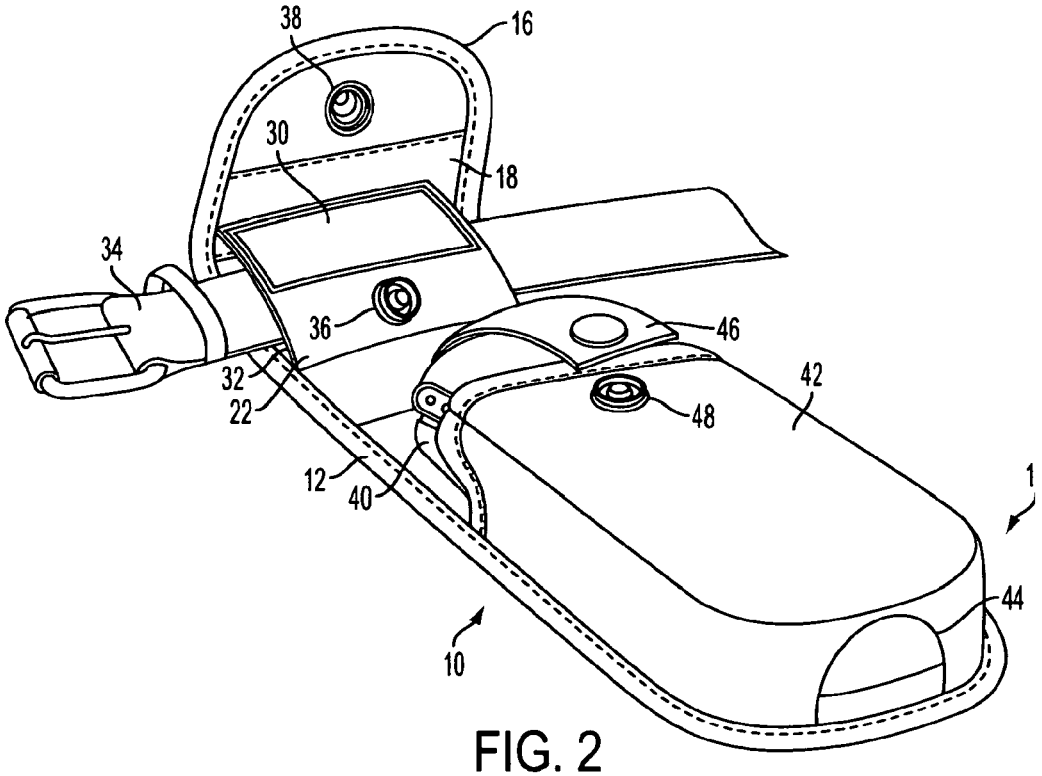
FIG. 2 illustrates the device holder of FIG. 1 showing its attachment to an article of clothing through a belt.

Referring first to FIGS. 1 and 2, the device holder of this invention is shown generally at 10 with FIG. 1 illustrating its attachment to a garment using a belt loop as an attachment point, and FIG. 2 showing its attachment to a belt. Device 10 includes a backing member 12 which is divided near its upper end by fold 14 to form a first flap 16. A fastener strip 18, suitably of the hook and loop type such as Velcro, is located at the lower edge of flap 16 adjacent the fold 14. The backing member 12 has a port or opening 20 placed below and adjacent to fold 14. Port 20 is sized to accept a belt loop and is preferably of rectangular shape.

A second outwardly extending flap 22 is attached along fold line 21 to backing member 12 at a point just below the bottom of port 20. When flap 22 is extended upwardly and outwardly, as is shown in FIG. 1, it uncovers belt loop capture strap 24 which is fixed to member 12, either permanently or detachably, at one strap end 25. The free end of strap 24 is passed through a belt loop 26 and is then secured to backing member 12 by way of a first snap fastener 28 or similar securing means. After the free end of strap 24 is secured, flap 22 is folded inwardly toward member 12 to cover the belt loop 26 and strap 24. If strap 24 is detachable, then it is desirable to provide a storage locale on the holder, suitably on the back side of member 12.

As is best shown in FIG. 2, a second fastener strip 30 is placed along the top outer margin of flap 22 so that it will securely mate with fastener strip 18 when first flap 16 is folded downwardly. In addition to covering up the belt loop and strap, folding and securing the first flap creates a channel 32 between backing member 12 and the rear side of flap 22. Channel 32 is sized to accommodate a belt 34, or other strap means such as those used with purses, back packs, and similar carrying means so that the device holder of this invention can be attached to those straps as well as to a belt or belt loop. A second snap-type fastener having a male part 36 is located in the upper region of flap 16 above fastener strip 18, while a corresponding female part 38 is placed on the outer side of flap 22 at a location at which it will mate with part 36 to thereby secure flap 16 in a closed position.

The device holder that is illustrated in the drawings is specific for use with a typical cell phone 40. In this particular embodiment, a cover 42 is attached to the lower region of backing member 12. Cover 42 is sized and shaped so that it forms a pocket or holster in cooperation with the backing member that fits a particular cell phone or type of cell phones. It is advantageous to provide an opening 44 in cover 42 at or near its bottom to allow finger access to the bottom of a cell phone within the holder allowing a user to push the phone upwardly, thus aiding its removal from the holder. A securing member, which may be a strap 46, is fixed at one end to backing member 12 at a location adjacent the top of cover 42. Strap 46 is arranged to fold over the top of a cell phone or other device in place within the holder and is secured at its free end to the exterior of cover 42 by fastener means 48. Fastener means 48 may be, for example, a conventional snap fastener or may be a magnetic fastener which comprises paired magnets or a magnet paired with a ferromagnetic material.

Figure 3:
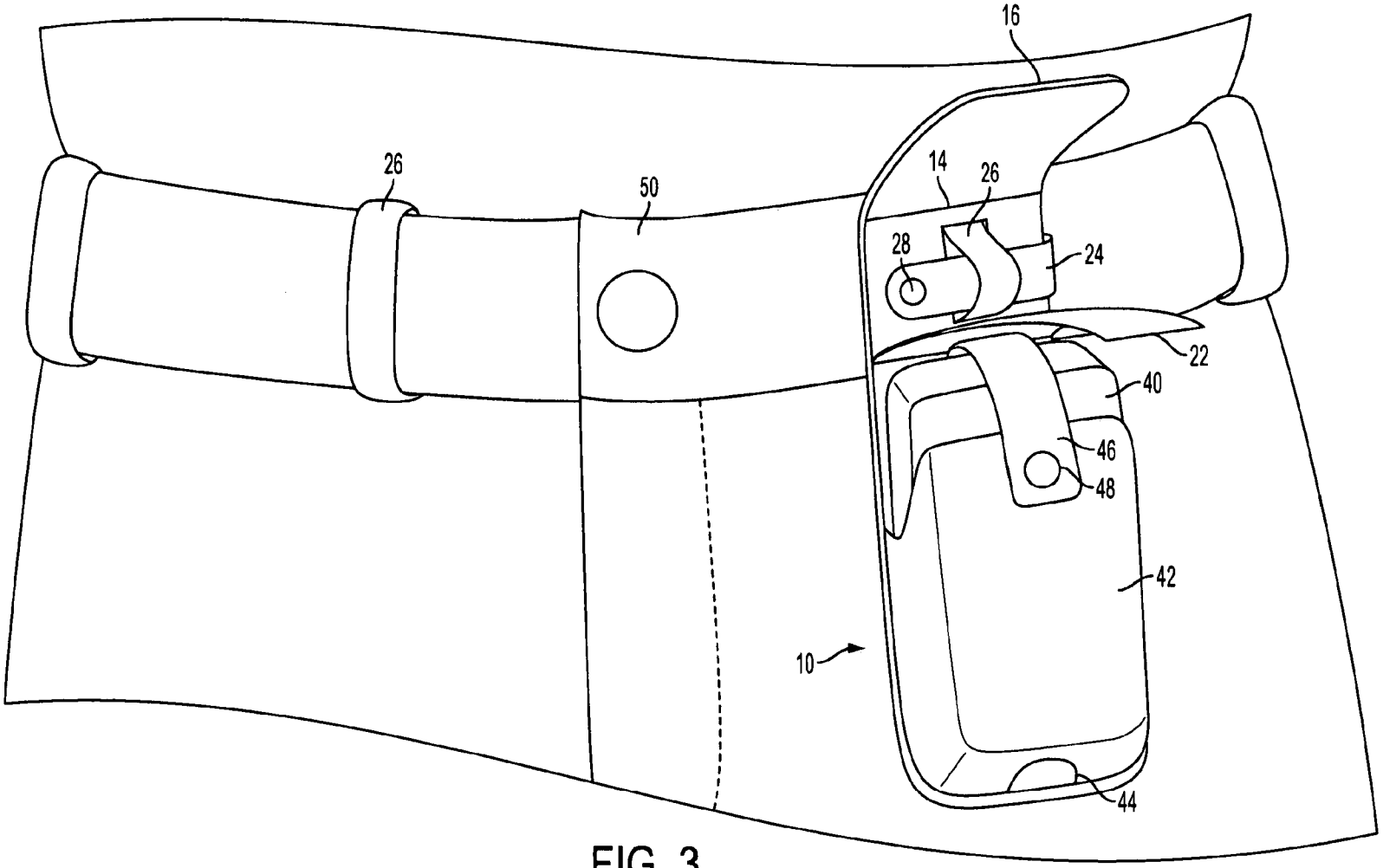
FIG. 3 is a front view of the device holder worn by a user.
Figure 4:
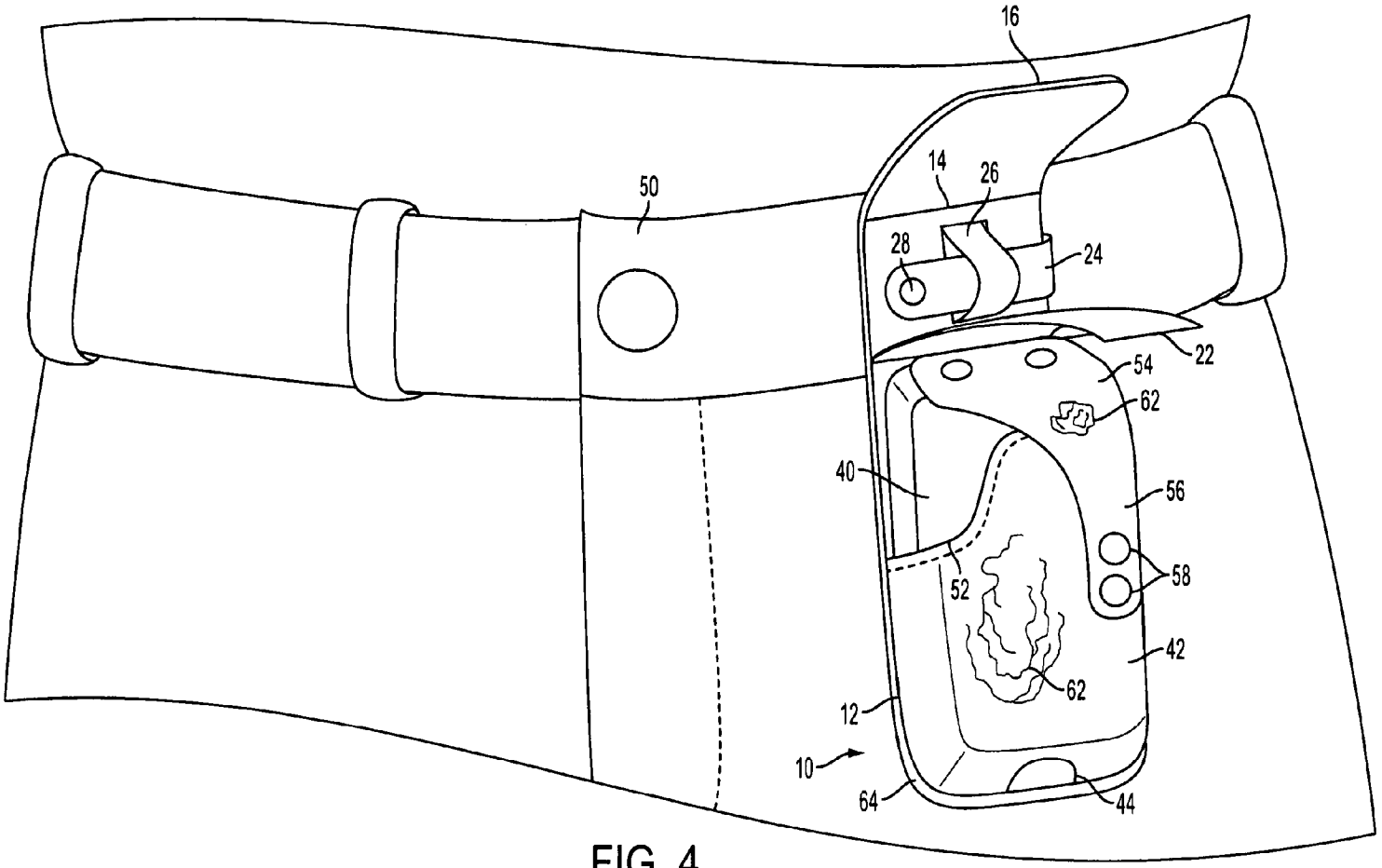
FIG. 4 is another embodiment of the device holder that is illustrated in FIGS. 1-3.

Referring now to the remaining drawings, FIG. 3 is a front view of the device holder 10 of FIGS. 1 and 2 showing its attachment to the clothing 50 of a user using a belt loop as an attachment point. Attachment is completed by lifting flap 22 upwardly to cover the belt loop, and thereafter lowering and securing flap 16. FIG. 4 shows another embodiment of the device holder that is illustrated in FIGS. 1-3. In this embodiment, cover 42 is modified by shortening the front and the upper margin 52 of one cover side to allow faster and easier access to the device, which in this illustration is a cell phone. Securing strap 46 of the FIGS. 1-3 embodiment is replaced with a securing flap 54 which extends across substantially the entire top width of cover 42 so as to prevent the cell phone or other device from slipping out of the holder. Flap 54 terminates in a strap-like appendage 56 extending downwardly to one side of the cover and is secured to the top of the cover by means of fasteners 58. Those fasteners are preferably adjustable in position, up and down, so as to accommodate articles of differing height, and are suitably magnetic fasteners which consist of one or more magnets which adhere to ferromagnetic regions placed on the cover top. The holder cover 12 and the exterior surface of the securing flap 54 may also serve another function as a platform 62 for advertising matter, company logos, trademarks, decorative features, and the like for use as promotional giveaways, meeting favors, fashion accessories, and other similar purposes.

There have been concerns expressed as to the possible harm to a user from radiation emitted by a cell phone or other electronic device. As is illustrated in FIG. 4, the backing member 12 may be formed as a multi-layered laminate in which at least one layer 64 comprises a radiation barrier. Further, cover 42 may include a signal blocking material to prevent digital data stored on or emitted by the device to be intercepted or stolen.

Figure 5:
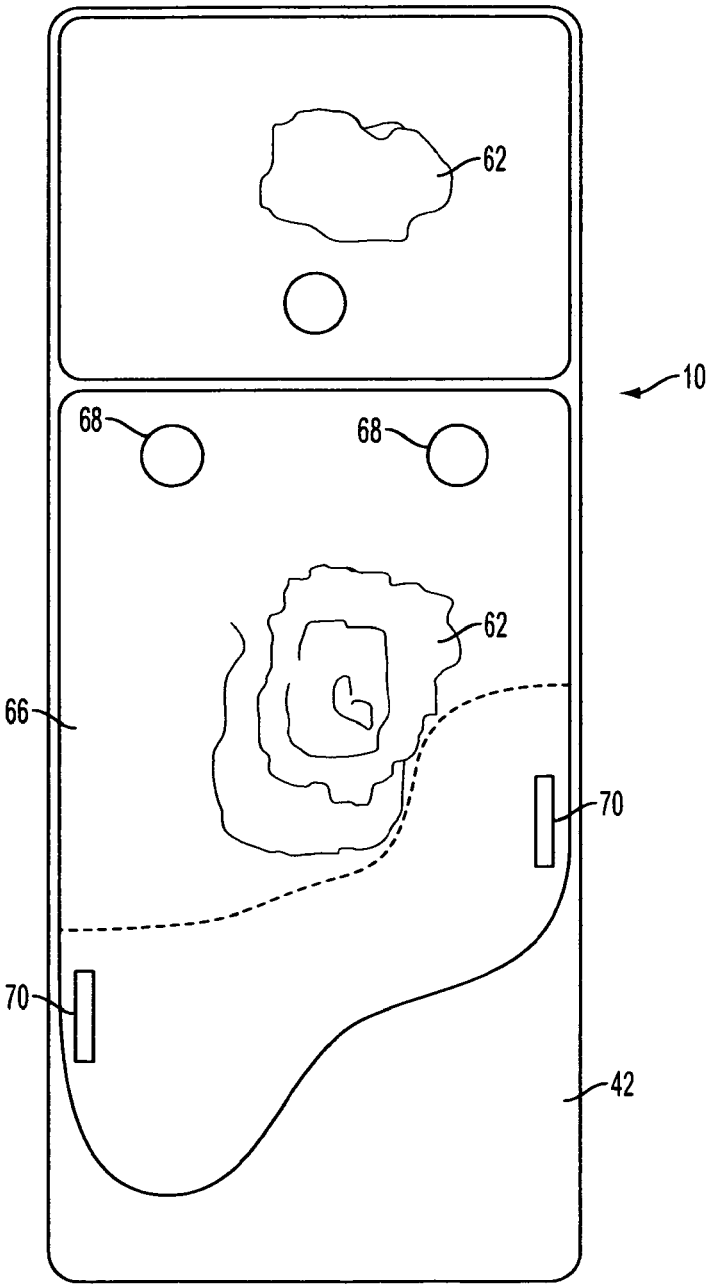
FIG. 5 illustrates another variation of the device holder that is particularly suitable as a platform for advertising matter or adaptable to personalization of the holder for an individual user.

FIG. 5 is a plan view which illustrates an embodiment of the holder of this invention that is specially adapted to enhance its fashion appeal. In this embodiment, flap 66 is sized to cover most of the top surface of cover 42 and is removably attached to the holder at the cover top by fastening means such as the snap fasteners 68 that are illustrated. The flap bottom is held to the cover using magnetic fasteners or the like. This embodiment allows the appearance of the holder to be changed at will simply by switching a first flap 66 for a second flap that is identical to the first except for the indicia carried on platform 62. That feature offers great economy in marketing to different small and defined groups as compared to marketing the entire holder, with different indicia, to the same groups. Thus, unlimited customization of device holders is facilitated.

Figure 6:
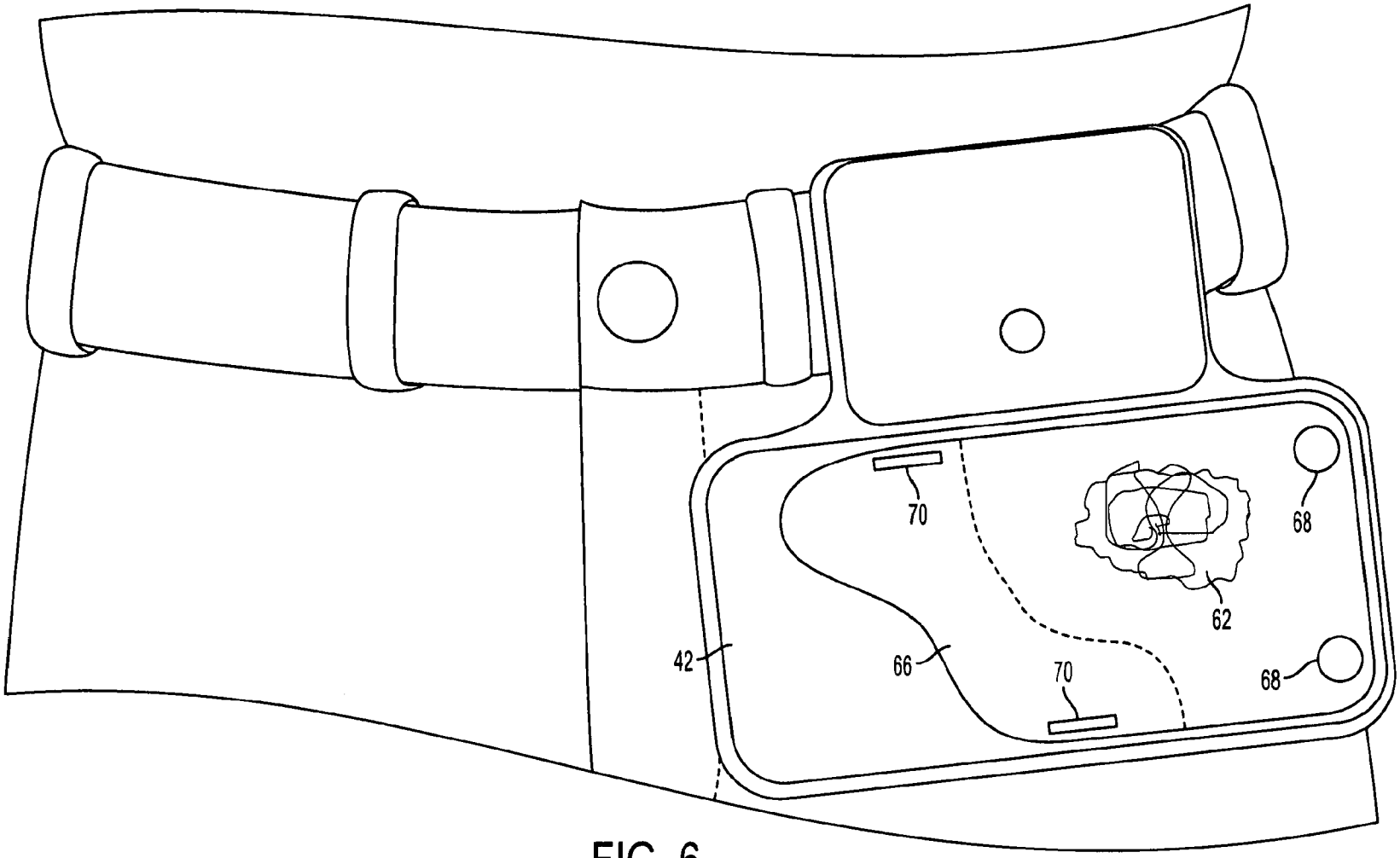
FIG. 6 illustrates a different orientation of the pocket part of the device holder illustrated in the other Figures.

FIG. 6 illustrates the embodiment of FIG. 5 in which the pocket part of holder 10 is rotated 90 degrees so that flap 66 opens to the side with the cell phone resting on its side rather than being held vertically. Otherwise, the holders shown in the two figures are identical.

As may now be appreciated, the device holder of this invention provides a safer and more convenient way to carry items and to keep them available for immediate use. It does not come off when running and is resistant to pilferage. It is versatile, allowing the device holder to be attached to either a belt or belt loop of a user's clothing, allows one-hand withdrawal of the device from the holder, and maintains secure protection against accidental loss. The device holder also may be attached to the straps of another item such as a back pack or laptop computer case. Although the device holder has been described in relation to its use as a carrier for a cell phone, the holder can easily be modified in size and shape to carry a vast range of small items including, for example, wallets, passports, trade tools, glasses, medical devices or supplies, GPS units, cameras, electronic test equipment, and a host of similar items.

The embodiments described herein are exemplary and numerous variations, modifications and uses will be evident to one of ordinary skill in the art.

We claim:

1. A holder for a small item such as a cell phone, comprising:

a backing member that is divided near its upper end by a lateral fold to thereby form a first flap;

a cover attached to the lower region of the backing member, said cover and said backing member forming a pocket to accommodate the item;

a second outwardly extending flap attached to the backing member at a location adjacent to and above the top of said cover, said second flap arranged to form a channel in cooperation with the backing member when said second flap is folded inwardly and upwardly toward the backing member and said first flap is folded downwardly toward the backing member over the second flap, said channel sized to accommodate a belt, wherein the channel formed between the second outwardly extending flap and the backing member extends to the location of attachment between the second outwardly extending flap and the backing member;

an opening in said backing member located below and adjacent to said fold, the opening sized to accept a belt loop; and a belt loop capture strap that is secured at one end to the backing member at one side thereof, the free strap end arranged to pass through a belt loop and to then detachably fasten to the other side of the backing member.

2. The holder of claim 1 wherein the channel formed in cooperation with the second outwardly extending flap and the backing member extends from the lateral fold of the backing member to the location of attachment between the second outwardly extending flap and the backing member.

3. The holder of claim 1 including fastening means at the lower edge of said first flap adjacent said fold, and mating fastening means adjacent the top outer margin of said second flap.

4. The holder of claim 1 wherein the cover is sized and shaped to hold a cell phone, the holder including a securing strap that is fixed at one end to the backing member at a location adjacent the cover top, the strap arranged to fold over the cell phone top to hold it in place within the cover, and the free end of the strap detachably secured to the exterior of the cover.

5. The holder of claim 4 wherein said securing strap is formed as a first securing flap that extends across the width of said cover, said securing flap having indicia on its outer surface and being removably attached to the holder and interchangeable with another securing flap that is identical to the first except for the indicia on the flap outer surface.

6. The holder of claim 1 wherein said backing member and said cover each include a radiation shield for radiation emitted from an electronic device disposed within the pocket and to prevent digital data stored on or emitted by the electronic device to be intercepted or stolen, respectively.

7. The holder of claim 6 wherein the channel formed in cooperation with the second outwardly extending flap and the backing member extends from the lateral fold of the backing member to the location of attachment between the second outwardly extending flap and the backing member.

8. The holder of claim 6 including fastening means at the lower edge of said first flap adjacent said fold, and mating fastening means adjacent the top outer margin of said second flap.

9. The holder of claim 6 wherein the cover is sized and shaped to hold a cell phone, the holder including a securing strap that is fixed at one end to the backing member at a location adjacent the cover top, the strap arranged to fold over the cell phone top to hold it in place within the cover, and the free end of the strap detachably secured to the exterior of the cover.

10. The holder of claim 9 wherein said securing strap is formed as a first securing flap that extends across the width of said cover, said securing flap having indicia on its outer surface and being removably attached to the holder and interchangeable with another securing flap that is identical to the first except for the indicia on the flap outer surface.

* * * * *